United States Patent [19]

Strausheim

[11] Patent Number: 4,499,128

[45] Date of Patent: Feb. 12, 1985

[54] ADJUSTABLE DIVIDER STRIP MOUNTING FOR PLASTIC TRAYS

[75] Inventor: Myron A. Strausheim, Richmond, Ind.

[73] Assignee: American Desk Mfg. Co., Temple, Tex.

[21] Appl. No.: 532,224

[22] Filed: Sep. 14, 1983

[51] Int. Cl.[3] ..... B32B 1/00

[52] U.S. Cl. ..... 428/35; 206/555; 206/557; 206/566; 206/820; 428/83; 428/122

[58] Field of Search ..... 206/555, 820, 557–566; D7/38; 428/83, 35, 122

[56] References Cited

U.S. PATENT DOCUMENTS

| | | | |
|---|---|---|---|
| 962,981 | 6/1910 | Rueckert | 206/561 |
| 3,851,808 | 12/1974 | Schilling | 206/557 |

*Primary Examiner*—William J. Van Balen

*Attorney, Agent, or Firm*—Littlepage & Webner

[57] ABSTRACT

An extruded plastic tray has along the upper side of its rear portion a forwardly opening "C"-shape channel into which "C"-shape clips slideably engage by bowing the bights of the clips so that the arms of the "C"-shape clips can pass between the arms of the "C"-shape channel on the tray. In the bights of the clips are "I"-shape slots through which the ends of divider strips may be forced so as to bend back the side edges of the stem of the "I".

4 Claims, 3 Drawing Figures

ADJUSTABLE DIVIDER STRIP MOUNTING FOR PLASTIC TRAYS

RELATED APPLICATION

Strausheim PLASTIC TRAY filed concurrently herewith.

OBJECTS

The object of this invention is to provide a mounting on a tray for divider strips which may be adjusted along the length of the tray. In particular it is intended that the mountings for the divider strips be easily assembled on the tray without the need to disassemble the tray to add more divider strips, and that the divider strips themselves may be easily inserted and firmly held into and by the clip mountings.

These and other objects will be apparent from the following specification and drawing in which.

Figure 1:
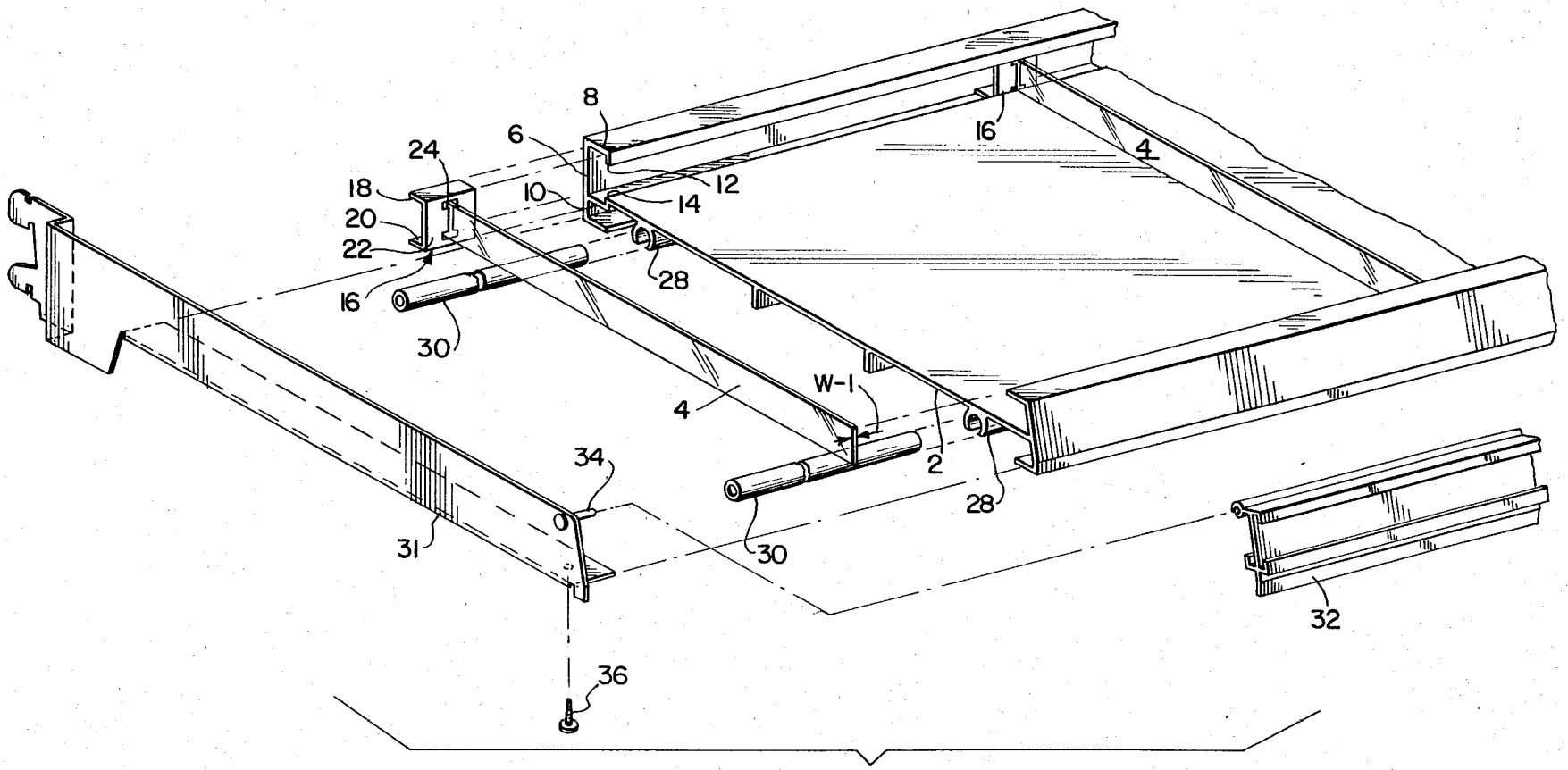
FIG. 1 is an exploded isometric view showing the tray, the divider strips and their mountings.
Figure 2:
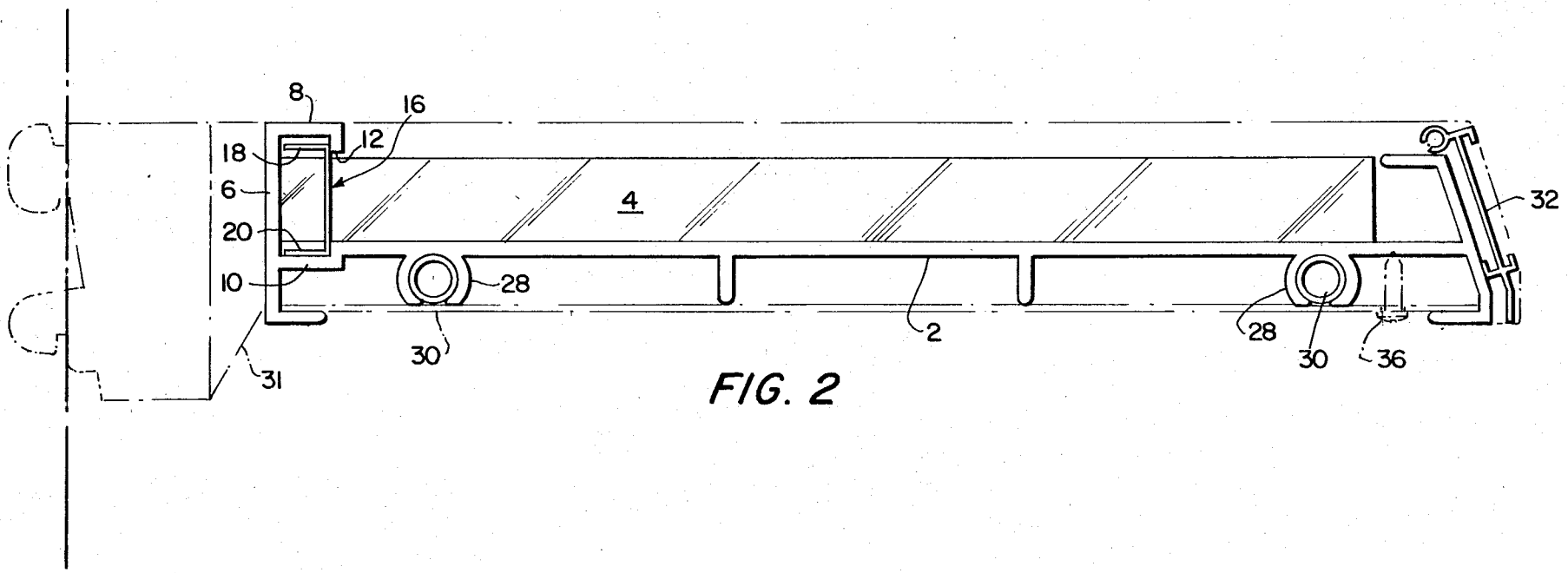
FIG. 2 is an end view of the assembly shown in FIG. 1.
Figure 3:
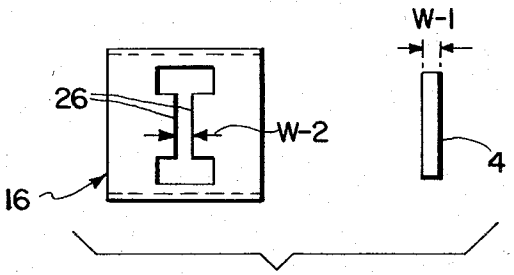
FIG. 3 is an exploded detail of the divider strip mounting in front elevation and a divider strip in end elevation.

Referring now to the drawings, the normally horizontal tray 2 is preferably of extruded plastic material as are the divider strips 4. Extending along one side of the tray, preferably along the rear portion, and on the upper side is an integral forwardly open "C"-shape channel 6 having spaced arms 8 and 10 terminating in oppositely facing lips 12 and 14. The divider strips are adjustably held in channel 6 by flexible clips 16, which are preferably rearwardly-open, flat, "C"-shape flexible plastic clips comprised of arms 18 and 20 connected by a bight portion 22. In the forwardly facing portion 22 of each clip 16 is an "I"-shape slot 24 with the stem of the "I" having closely spaced edges 26. The width W-1 of the divider strip 4 is slightly greater than the spacing W-2 between the edges 26 of the stem of the "I"-shape slot 24 so that the edges of the stem of the "I"-shape slot 24 must be deflected rearwardly by the end of the divider strip 4 when the latter is jammed into the slot. This rearward deflection of the slot edges produces a "carpenter's trap" type function such that the strip is trapped in the slot and cannot easily be dislodged by pulling it back out oppositely from the way it went in. The clips 16 may be slid along channel 6 to selected positions either before or after divider strips have been engaged in them.

The span between the arm portions of a "C"-shape clip is normally greater than the span between the lips on the channel, the bight of the clip being sufficiently flexible to be manually bowed until the span between the arm portions of the clip is less than the span between the lips of the channel arm portions, thus enabling the clip to be inserted into the channel. The clips may be other than "C"-shape so long as they are engageable in the substantially "C"-shape channel of the tray.

Additional divider strips may be added without the need to dismantle the tray by snapping additional clips into the "C"-shape channel and then inserting divider strips into the clips.

Molded on the underside of the tray are integral downwardly-open "C"-shape channels 28 into which metal reinforcing roads 30 may be snapped, this being the subject matter of my co-pending application, supra. A price-tag supporting channel 32 is pivotally supported between brackets 31 by pivot pins 34, and the tray is pinned to each bracket by a sharp screw 36 which engages through a hole in the bracket flange and penetrates the tray material. The price-tag channel and sharp screws are detailed merely for purposes of completeness of disclosure of the best mode for practicing the invention.

I claim:

1. A divider strip and mounting for a tray having front and rear sides, said tray having an elongate forwardly open substantially "C"-shape channel disposed along the rear side thereof, the "C"-shape of said channel being formed by generally oppositely facing arm portions, said mounting comprising a clip, said clip having an aperture therethrough, said clip slidingly engaging in the channel for lengthwise sliding movement therein and being normally blocked against forward disengagement therefrom by the arm portions of the channel and means for connecting an end portion of the divider strip through the clip aperture.

2. A divider strip and mounting for extruded plastic normally horizontal trays having front and rear sides comprising a forwardly-open substantially "C"-shape channel disposed along the rear side of the tray, said channel having oppositely disposed upper and lower arm portions terminating at forward ends in oppositely disposed lips and connected at rear ends by a bight portion, and a generally "C"-shape clip of flat flexible resilient plastic material comprised of oppositely disposed upper and lower arm portions connected by a bight portion, the span between the arm portions of the clip being normally greater than the span between the lips on the channel arms and the bight of the clip being sufficiently resilient as to be manually flexed until the span between the arm portions of the clip is less than the span between the lips of the channel arm portions, so as to permit insertion of the flexed clip into the channel and whereby, when the inserted clip is released, it resumes its normal condition and is blocked against removal from the channel by the lips of the channel, and means for connecting an end portion of the divider strip through the bight portion of the clip.

3. The combination claimed in claim 2, said means comprising an "I"-shape slot in the bight portion of the clip wherein the distance between the edges of the stem of the "I" is normally less than the thickness of the divider strip, whereby insertion of the divider strip through the stem of the slot flexes the sides of the slot aside and traps the strip therein.

4. The combination claimed in claim 3 wherein said "C"-shape clip is slideably engaged in said "C"-shape channel.

* * * * *